US007553431B2

(12) United States Patent
Hayner et al.

(10) Patent No.: US 7,553,431 B2
(45) Date of Patent: Jun. 30, 2009

(54) TECHNIQUES AND COMPOSITIONS FOR SHIELDING RADIOACTIVE ENERGY

(75) Inventors: Roger E. Hayner, Hebron, KY (US); Phillip R. Terry, Hamilton, OH (US); Dennis Dean Loyd, West Chester, OH (US)

(73) Assignee: Terry Industries, Inc., Hamilton, OH (US)

( * ) Notice: Subject to any disclaimer, the term of this patent is extended or adjusted under 35 U.S.C. 154(b) by 0 days.

(21) Appl. No.: 12/245,228

(22) Filed: Oct. 3, 2008

(65) Prior Publication Data

US 2009/0039318 A1 Feb. 12, 2009

Related U.S. Application Data

(62) Division of application No. 10/959,240, filed on Oct. 6, 2004, now Pat. No. 7,449,131.

(51) Int. Cl.
*G21F 1/10* (2006.01)
*G21C 7/24* (2006.01)

(52) U.S. Cl. ..... 252/478; 588/5; 588/6; 588/16

(58) Field of Classification Search ..... 252/478
See application file for complete search history.

(56) References Cited

U.S. PATENT DOCUMENTS

| | | | |
|---|---|---|---|
| 2,971,732 | A | 2/1961 | Woody |
| 3,140,248 | A | 7/1964 | Bell |
| 3,152,093 | A | 10/1964 | Boykin et al. |
| 3,203,906 | A | 8/1965 | Evans et al. |
| 3,222,151 | A | 12/1965 | Schreffler |
| 3,272,098 | A | 9/1966 | Theodore et al. |
| 3,516,948 | A | 6/1970 | Cledat et al. |
| 3,637,558 | A | 1/1972 | Verdol et al. |
| 3,904,377 | A | 9/1975 | Honda et al. |
| 3,935,467 | A | 1/1976 | Gablin |
| 4,020,355 | A | 4/1977 | Czaplinski |
| 4,074,141 | A | 2/1978 | Bryant |
| 4,084,097 | A | 4/1978 | Czaplinski |
| 4,173,018 | A | 10/1979 | Dawson et al. |
| 4,176,093 | A | 11/1979 | Zoch |
| 4,200,804 | A | 4/1980 | Farella et al. |
| 4,241,728 | A | 12/1980 | Mirell |
| 4,243,513 | A | 1/1981 | Horowitz et al. |
| 4,252,667 | A | 2/1981 | Stegmaier et al. |
| 4,265,563 | A | 5/1981 | Marzocchi et al. |
| 4,299,658 | A | 11/1981 | Meuschke et al. |
| 4,330,449 | A | 5/1982 | Maldonado et al. |
| 4,401,108 | A | 8/1983 | Galkin et al. |
| 4,460,499 | A | 7/1984 | Boden |

(Continued)

FOREIGN PATENT DOCUMENTS

| | | |
|---|---|---|
| FR | 1264300 | 6/1961 |

(Continued)

*Primary Examiner*—Joseph D Anthony
(74) *Attorney, Agent, or Firm*—Schwegman, Lundberg & Woessner, P.A.

(57) ABSTRACT

Techniques and compositions are provided for shielding radioactive energy. The composition includes a hydrocarbon component and a radiation shielding and absorbing material or additive. The composition may be applied to substrates or to radioactive materials. Moreover, the composition may be mixed with raw materials of products.

6 Claims, 3 Drawing Sheets

U.S. PATENT DOCUMENTS

| | | | |
|---|---|---|---|
| 4,581,538 | A | 4/1986 | Lenhart |
| 4,671,848 | A | 6/1987 | Miller et al. |
| 4,710,266 | A | 12/1987 | Hayashi et al. |
| 4,725,383 | A | 2/1988 | Hayashi et al. |
| 4,750,984 | A | 6/1988 | Ott |
| 4,832,874 | A | 5/1989 | Nohmi |
| 4,876,593 | A | 10/1989 | Bauer et al. |
| 5,017,230 | A | 5/1991 | Hopkin et al. |
| 5,098,480 | A | 3/1992 | McGinnis et al. |
| 5,128,203 | A | 7/1992 | Laroche |
| 5,143,653 | A | 9/1992 | Magnin et al. |
| 5,331,028 | A | 7/1994 | Goodrich |
| 5,374,672 | A | 12/1994 | Chaverot et al. |
| 5,414,197 | A | 5/1995 | Wakeley et al. |
| 5,416,334 | A | 5/1995 | Knapp et al. |
| 5,580,376 | A | 12/1996 | Hayner |
| 5,601,697 | A | 2/1997 | Miller et al. |
| 5,605,946 | A | 2/1997 | Planche |
| 5,707,922 | A | 1/1998 | Mimori et al. |
| 5,733,659 | A | 3/1998 | Iwakiri et al. |
| 5,756,565 | A | 5/1998 | Germanaud et al. |
| 5,795,929 | A | 8/1998 | Grubba |
| 5,981,010 | A | 11/1999 | Terry et al. |
| 6,027,557 | A | 2/2000 | Hayner |
| 6,133,351 | A | 10/2000 | Hayner |
| 6,166,284 | A | 12/2000 | Oelsner |
| 6,488,755 | B1 | 12/2002 | Seyler et al. |
| 6,538,060 | B2 | 3/2003 | Rajalingam et al. |
| 6,589,158 | B2 | 7/2003 | Winkler |
| 6,666,904 | B1 | 12/2003 | Lough |
| 6,669,757 | B1 | 12/2003 | Lough |
| 7,241,821 | B1 * | 7/2007 | Hayner et al. ..... 524/68 |
| 7,250,119 | B2 | 7/2007 | Sayala |
| 7,449,131 | B2 * | 11/2008 | Hayner et al. ..... 252/478 |
| 7,518,028 | B2 * | 4/2009 | Loyd et al. ..... 588/5 |
| 2002/0114940 | A1 | 8/2002 | Clemens et al. |
| 2002/0179860 | A1 | 12/2002 | Smith |
| 2005/0053745 | A1 | 3/2005 | Bartek et al. |
| 2005/0095399 | A1 | 5/2005 | Loyd et al. |
| 2005/0258404 | A1 | 11/2005 | McCord |
| 2005/0258405 | A1 | 11/2005 | Sayala |
| 2006/0074141 | A1 | 4/2006 | Hayner et al. |

FOREIGN PATENT DOCUMENTS

| | | | |
|---|---|---|---|
| GB | 925505 | | 5/1963 |
| WO | WO-2005055624 | A2 | 6/2005 |
| WO | WO-2006057712 | A2 | 6/2006 |
| WO | WO-2006057712 | A3 | 6/2006 |

* cited by examiner

TECHNIQUES AND COMPOSITIONS FOR SHIELDING RADIOACTIVE ENERGY

CROSS-REFERENCE TO RELATED APPLICATION

This patent application is a Continuation of U.S. patent application Ser. No. 10/959,240, filed Oct. 6, 2004 now U.S. Pat. No. 7,449,131 and entitled "TECHNIQUES AND COMPOSITIONS FOR SHIELDING RADIOACTIVE ENERGY", the contents of which are incorporated herein by reference in its entirety.

FIELD OF THE INVENTION

The invention is related to containment of radioactive energy.

BACKGROUND OF THE INVENTION

There has been and continues to be a need for a techniques to safely encapsulate and to store hazardous nuclear waste generated from either defense, utility, or medical uses that both shields the environment from gamma, neutron, and x-ray particles. It is generally agreed that exposure to even low-level radioactive emission is highly undesirable.

The use of medicinal grade radioactive solutions is undergoing great expansion. Furthermore, Military defense use of radioactive materials in submarines and other areas creates additional levels of toxic radioactive materials. Safety issues exist today in the uranium enrichment plants, which have been decommissioned leaving behind a plethora of contaminated soils, equipment, and wastes that have to be properly disposed of. Moreover, utilities continue to create significant amounts of nuclear waste from power generation plants.

To date, the waste disposal process has largely been associated with the casking of waste into concrete castings, which have been dosed with absorbing materials such as fly ash or others. However, the absorbing materials can leach into the environment, if the concrete is damaged or cracked. Concrete is a hard and brittle material, which has a high potential for cracking, even when shrinkage naturally occurs as moisture escapes from it during a curing process. Cracking permits the escape of gamma radiation and the potential for radiation leaks.

Concrete castings are being utilized as safe storage techniques for radioactive waste at the disposal facilities and are optimistically expected to perform for hundreds of years as the radioactive materials decay to safe levels. The excessive weight of concrete and its thicknesses create transportation issues and further places limits on the practical size of storage containers.

In addition, the use of flyash in concrete (referred to as flyash concrete) has been the staple of the radioactive material shielding/absorption systems to date, since concrete has limits on the amount of solids, which may be added without effecting the structural integrity of the cement. Concrete has a degree of porosity, which allows for any moisture to eventually escape or permeate its structure, and many types of radioactive wastes have high levels of acidity, which can quickly attack concrete.

Accordingly, there continues to be a strong need for techniques, compositions, and materials that offer improved and cost effective radiation shielding. The techniques and compositions should improve the safety of handling, storing, transporting, managing, and disposing of radioactive waste.

SUMMARY OF THE INVENTION

Briefly and in general terms, a radioactive shielding composition is formed or otherwise provided. The composition includes a hydrocarbon component and a radiation shielding and absorbing material or additive. In one embodiment, the composition also includes a polymer and/or a crosslinking or curing agent.

In various embodiments, the composition is sprayed, brushed, rolled, or otherwise coated onto substrates. In other instances, the composition is sprayed, brushed or otherwise coated onto radioactive material. In still other cases, the composition is mixed with raw materials of other products. The composition provides novel non-leaching gamma and neutron radiation shielding or absorbing properties.

DETAILED DESCRIPTION OF THE INVENTION

Figure 1:
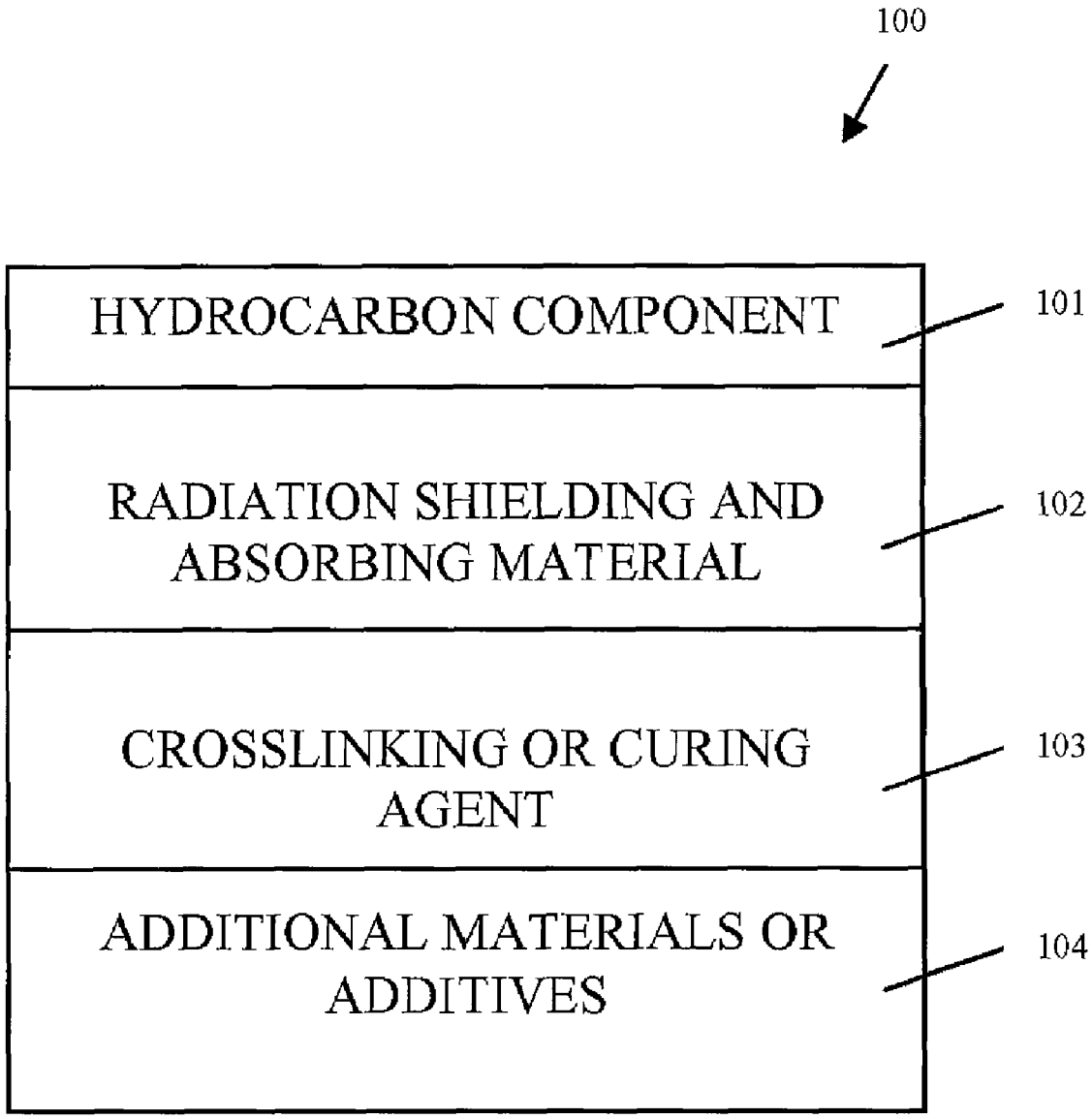
FIG. 1 is a block diagram of a radioactive shielding composition, according to an example embodiment of the invention.

While concrete castings are conventionally used in the industry for radioactive containment, there still exists many shortcomings with concrete castings and therefore a need for a more permanent and safer method of encapsulating radioactive waste. Embodiments of the present inventions use leaded glass and various other neutron absorption agents in combination with a hydrocarbon component, such as asphalt (bitumen) to form novel radioactive shielding compositions. The novel radioactive shielding compositions presented with various embodiments of this invention teach improved alternatives to concrete castings.

Asphalt based materials are extensively used in a wide variety of applications. For example, asphaltic material is widely employed as a primary ingredient in coating compositions for structures, in sealants, and in waterproofing agents. Asphalt compositions have been used in paving mixtures with considerable advantage for many years. Many manufactured roofing materials, such as in roofing shingles, impregnated felts, tars, mastics, and cements are also based upon asphalt or compositions thereof. All applications rely on the wide range performance of asphalt to waterproof and seal while being flexible and able to adapt with the incorporation of modifiers into a wide range of climatic conditions and loading stresses.

In the case of paving asphalt, a typical paving asphalt mixture comprises a mixture of components, principal ingredients of the paving asphalt mixture being an asphalt composition or cement and aggregate or aggregate material. In such mixtures, the ratio of asphalt composition to aggregate material varies, for example, according to aggregate material type and the nature of the asphalt composition.

Generally, asphalt compositions in paving mixtures are less than 10% by weight and are usually in the range of 4-7% by weight of the composition. As used herein, the terms "Asphalt Composition" or "Asphalt Cement" are understood to refer to any of a variety of organic materials, either solid or semi-solid at room temperature, which gradually liquefy when heated, and in which the predominate constituents are naturally occurring bitumens or residues commonly obtained in petroleum, synthetic petroleum, or shale oil refining, from coal tar, or the like. For example, vacuum tower bottoms produced during the refining of conventional or synthetic petroleum oils are a common residue material useful as asphalt composition.

A "Paving Asphalt Composition" or "Paving Asphalt Cement" is an asphalt composition or asphalt cement having characteristics, which dispose the composition to use as a paving material, as contrasted for example, with an asphalt composition suited for use as a roofing material. "Roofing Asphalts", for example, usually have a higher softening point, and are thus more resistant to flow from heat on roofs, the higher softening point generally being imparted by the air blowing processes by which they are commonly produced. Paving asphalt mixtures may be formed and applied in a variety of ways, as are commonly produced. For example, the paving asphalt composition and the aggregate can be mixed and applied at elevated temperatures at the fluid state of the paving asphalt composition to form the pavement or road surface. There exist numerous modifiers, which may be added to the asphalt cement to impart higher softening points, greater levels of elasticity, and resistance to aging and cold temperature cracking. Various polymers, antioxidants, surfactants or antistripping agents as well as many other additives have been employed in paving, roofing, and industrial applications.

Radioactive wastes, as a natural result of their time-dependent decay and fission of radionuclides, emit alpha, beta, gamma, and neutron radiation. Of those types of radiation, the neutron and gamma radiation are extremely harmful to the environment and human life. Wastes of radioactive materials may be in found in three distinct types commonly in either solid, liquid or sludge forms.

High-level radioactive wastes contain gamma emitting long-half life radionuclides, such as Plutonium (Pu-238, Pu239, Pu-240, and Pu-242) and Uranium (U-234, U-235, and U-236). High-level wastes include spent or used nuclear fuel and wastes from commercial and defense related nuclear reactors resulting from reprocessing of spent nuclear fuel. Most spent nuclear fuel in the United States is currently located in pools of water at nuclear generating plants across the country to protect workers from radiation. Spent fuel is also stored in large concrete casks as described above. High-level wastes are also generated from reprocessing of fuel from weapons production reactors to obtain materials to make nuclear weapons. These wastes are primarily in liquid form and can be either vitrified into a glass or solidified.

Transuranic (TRU) waste contains such radionuclides as Californium (Cf-249-Cf252), Americium (Am-241, AM-242, and AM-243), Curium (Cm242-Cm250), Neptunium (Np-235, Np-236), Plutonium (Pu-236-PU-242) and Berkelium (Bk-247, Bk-250). The half-life of TRU wastes are generally in the range of about 20 years. TRU wastes are commonly generated by defense nuclear research and development activities, such as those encountered during the development and fabrication of nuclear weapons. TRU waste is classified as either "Contact-Handled" (CH) or "Remote-Handled" (RH), which are highly radioactive with high radiation Neutron and Gamma fluxes. CH-TRU waste emits mostly alpha radiation and therefore this type of radiation does not require a heavy lead shielding.

Low-Level radioactive wastes do not include either High-Level or Transuranic waste materials. Most low-level wastes, classified by the Nuclear Regulatory Commission (NRC) as A, B, or C emit relatively low levels of radiation from radioactive decay of short half-life radionuclides, such as Strontium-90, Cesium-137, Krypton-85, Barium-133, and Beryllium-7 and Beryllium-10. Generally these wastes have radioactivity that decays to background levels in less than 500 years and about 95 percent of the waste decays to background levels in less than 100 years. Commercial and university laboratories, pharmaceutical industries and hospitals, as well as nuclear power plants generate low-level radioactive wastes, which can be addressed by the current invention. Low-level wastes include both solid and liquid wastes.

High-level wastes are very radioactive and emit extremely harmful Gamma and Neutron radiation. RH-TRU wastes are primarily Gamma and Neutron emitters and consequently, they use heavy shielding and should be handled robotically. CH-TRU wastes are also very radioactive and emit harmful Alpha radiation in addition to Neutron radiation. One of the main hazards of this type of radiation is its potential for exposure by inhalation or ingestion. Inhalation of certain transuranic materials, such as plutonium, even in very small quantities, can deliver a significant internal radiation dose.

Among Transuranic wastes; RH-TRU waste poses a significantly more hazardous risk than CH-TRU due to its emission of Gamma and Neutron radiation. Radiation emitted by Low-Level radioactive waste is significantly lower than that emitted by either High-Level or TRU radioactive wastes.

Exposure to Gamma and Neutron radiation, as well as Alpha and Beta radiation, which are associated with these wastes, can induce chronic, carcinogenic and mutagenic health effects that lead to cancer, birth defects, and death. Thousands of tons of both solid, liquid, and sludge radioactive wastes have been generated in the past and they will continue to be generated in the future by commercial and private industries as well as government agencies. Unless they are safely and cost effectively shielded, managed, and disposed, these wastes may pose serious health and economic consequences to the global environment. The techniques and compositions presented herein are adapted to address these issues.

Shielding from exposure to radiation varies with the type of waste and the type of radiation emission. Paper, skin or clothes can easily shield alpha radiation. Beta radiation on the other hand passes directly through paper, skin, or clothes but can be shielded by a thin layer of plastic, aluminum, or wood. Gamma and Neutron radiation, the most dangerous of all, are very penetrating with Neutron having the highest level of penetration potential. Gamma radiation can be blocked by heavy shielding materials such as lead, steel and Ducrete (depleted Uranium mixed with concrete). Neutron radiation easily penetrates through heavy metal shielding and only specially engineered and chemically formulated concrete blocks can shield penetration of Neutron radiation from its source.

High-Level radioactive wastes are currently stored at nuclear power plants and Department of Energy (DOE) facilities across the country. The DOE's Office of Civilian Radioactive Waste Management (OCRWM) is charged with identifying and developing a suitable site for deep geologic disposal of this waste. The OCRWM is currently conducting research and testing to determine the suitability of the Yucca Mountain, Nev. site for long-term storage and safe disposal of these wastes. Much concern continues to exist from Nevada and its citizens on the ability to safely store these materials. Citizens and environmental groups across the country also have concerns as to how this material can be contained for secure and safe transportation to these storage depots. The embodiments of the present invention address these safety and storage concerns.

Transuranic wastes are destined to be disposed into an already existing geologic repository at the WIPP site in Carlsbad, N. Mex. Class A and B low-level radioactive wastes are currently disposed in isolated shallow burial grounds. Greater than Class C low-level wastes use deep geologic disposal in specially licensed facilities.

Management and disposal of high-level, transuranic and low-level radioactive wastes are very risky and use safe and cost-effective radiation shielding materials and techniques to minimize or prevent exposure to radiation, especially neutron and gamma radiation. Management activities, prior to disposal, include handling, solidification of liquid wastes, loading, storage, radiation monitoring, reloading of wastes into transportable containers, and transport of the radioactive wastes and waste containers to disposal sites. During these activities, if effective shielding is not applied, exposure to radiation can occur and cause devastating, irreversible health damage to workers.

Management of these wastes prior to disposal consists of containing them in storage casks, canisters, and other forms of containments with conventional radiation shielding technologies. Currently conventional radiation shielding technologies, such as concrete-based technology, vitrification technology, synthetic-rock technology and ducrete technology are used for management and disposal of these radioactive wastes. These technologies are made up of either single or double component shielding materials and have limitations in terms of their effectiveness in full radiation (i.e. both neutron and gamma radiation) shielding, stability of the shielding materials, and ease of application and cost effectiveness.

Concrete technology fails due to its inherent brittleness and inability to withstand impact. Once cracked, radiation easily penetrates through its once continuous encapsulation. Concrete also fails due to its inherent weight, which limits the amount and size of the encapsulation that can be easily handled or transported. The shielding effectiveness is limited in concrete compositions which are currently used for encapsulating and shielding.

Embodiments of the current invention provide for a much higher level of shielding materials to be incorporated into the encapsulating medium and provide a medium which remains flexible and elastomeric over a wide range of temperatures. This improved shielding material provides significantly higher radiation shielding performance. Alternatives to the embodiments of this invention, such as sufficient size lead (Pb) containment vessels of suitable sizes would be too heavy and bulky for ease of handling and cost prohibitive. It is also unclear if an adequate supply of lead is available to provide enough containers to capture the currently existing waste stockpiles.

FIG. 1 illustrates a block diagram of a radioactive shielding composition 100, according to an example embodiment of the invention. The radioactive shielding composition 100 minimally includes a hydrocarbon component 101 and a radiation shielding and absorbing material 102. In an embodiment, the radioactive shielding composition 100 may also include a crosslinking or curing agent 103 and/or other additional materials or additives 104.

In an embodiment, the hydrocarbon component or medium 101 is petroleum asphalt. The radioactive shielding composition 100 may also include a stabilizing amount of polymer (s) (additional materials or additives 104), a reactive amount of curing agents 103, crosslinkers 103, or reactants so as to stabilize the polymer and incorporate it intimately with the asphalt. The radioactive shielding composition 100 may also include fillers or extenders to provide body and additional shielding or absorption, a stabilizing amount of antioxidants or stabilizers, and an amount of virgin or recycled radioactive shielding or absorptive additives or materials 102 suitable to provide the degree of shielding and absorption so desired for the application, including but not limited to alpha, beta, gamma and neutron shielding mediums.

The radioactive shielding composition 100 may be used in a wide variety of applications for containing, managing, handling, storage and disposal of nuclear wastes. They are particularly unique in that they remain functional over a wide range of temperatures, provide Alpha, Beta, Gamma and Neutron shielding capabilities as well as function as a barrier and shielding material for many other types of radiation including but not limited to X-rays, Radon, and other types commonly known to those skilled in the art.

The use of the hydrocarbon medium or component 101 with the radioactive shielding and absorptive mediums or materials 102 provides for a synergistic effect due to the presence of polar constituents and the presence of a significant number of hydrogen molecules present in the hydrocarbon medium 101.

In an embodiment, the natural occurring elements within the asphalt component (hydrocarbon component 101) help to both shield and absorb various types of radiation emissions. Further, the addition of additional metals, their alloys, additives and minerals, both synthesized and naturally occurring can provide additional levels of shielding and absorption (additional materials or additives 104).

The composition 100 and various instances of combinations of the composition 100 may be incorporated in and/or used as encapsulants, used as stabilizers, used as shields, and used to prevent any leaching of the radioactive materials from a containment system. This may be achieved by shielding fillers for cask type multi-wall shipping containers with the composition 100, thereby forming protective barrier sheets, coatings, and binders thereof.

The composition 100 may be also be applied or incorporated into radioactive shielding applications or into the radioactive waste handling and storage applications by hot melt application, reactive one and two component systems, used as solvent cutbacks, or used as emulsions which solidify upon application to satisfy a variety of needs for protecting workers and the environment when handling and disposing of nuclear waste and/or radioactive materials.

The composition 100 may be provided as a material which can be used to waterproof nuclear waste storage sites, incorporated into the storage containers themselves, line drainage ditches and troughs to provide a barrier to the soil underneath so as to prevent further contamination, or be applied to underlying soils prior to pouring concrete flooring slabs to prevent the migration of Radon gas into basements or living areas.

The hydrocarbon component 101 or the composition 100 may include Asphalt, Petroleum Pitch, SDA (Solvent Deasphalted Pitch), hydrocarbon resins, heavy hydrocarbon bottoms, or recycled lube oil bottoms, and/or any mixtures thereof. Coal tar may be incorporated, but from a health effects and leachability standpoint, its use may be limited.

In an example embodiment, the hydrocarbon component 101 is asphalt. The term "asphalt" (sometimes referred to as "bitumen") refers to all types of asphalts (bitumen), including those that occur in nature and those obtained in petroleum processing. The choice depends essentially on the particular application intended for the resulting asphalt composition. In an embodiment, the hydrocarbon component 101 has an initial viscosity at 140° F. (60° C.) of 50 to 10,000 poise (measured by ASTM method D-2170 for absolute viscosity). The initial penetration range of the base asphalt at 77° F. (25° C.)

is 0 to 500 dmm, such as 25 to 200 dmm, when the intended use is for preparing the radioactive shielding composition 100.

In some embodiments, asphalt, which does not contain any polymer, additives, or modifications, etc., may sometimes herein be referred to as "Base Asphalt". Suitable asphalt components include a variety of organic materials either solid or semi-solid at room temperature. These materials gradually liquefy when heated, and in which the predominate constituents are naturally occurring bitumens, e.g. Trinidad Lake Asphalt, or residues commonly obtained in petroleum, synthetic petroleum, shale oil refining, tar sands refining, or from coal tar or the like. For example, vacuum tower bottoms produced during the refining of conventional or synthetic petroleum oils are a common residue material useful as asphalt composition. Solvent deasphalting or distillation may also product the asphalt.

Solvent deasphalting (SDA) bottoms, or alternatively, those derived from the ROSE™ process, may be used as part or all of the asphalt of the hydrocarbon component 101 blends. SDA bottoms are obtained from suitable feeds such as vacuum tower bottoms, reduced crude (atmospheric), topped crude and hydrocarbons comprising an initial boiling point of about 450° C. (850° F.) or above. In an embodiment, the solvent deasphalted bottoms are obtained from vacuum tower bottoms, boiling above 538° C. (100° F.). Solvent deasphalting can be carried out at temperatures of 93-148° C. (200-300° F.). After solvent deasphalting, the resulting SDA bottoms have a boiling point above 510° C. (950° F.), above 538° C. (1000° F.), and a penetration of 0 to 100 dmm at 25° C. (77° F.), 0 to 70 dmm at 25° C. (77° F.).

In an embodiment, the asphalt hydrocarbon composition 101 may be vacuum tower bottoms or heavy residuum solely or partly material produced by distillation of oils, with or without any solvent extraction step. Such materials sometimes referred to as "asphalt cement", have a reduced viscosity relative to the SDA bottoms. Such asphalt cement component can have a viscosity of 100 to 5000 poise at 60° C. (140° F.), 250 to 4000 poise, e.g. 500 poise for AC5 or PG52-28 asphalt cements. The asphalt cement component is added in amounts of sufficient quantities to provide the resulting asphalt or hydrocarbon compositions 101 with the desired viscosities for their intended application, e.g. asphalt cement may be blended with SDA bottoms to produce asphalts having a viscosity of 500 to 2000 poise at 60° C. (140° F.).

Additionally, in an embodiment, Performance Graded (PG) asphalt binders may be employed with the composition 100 and may be selected from the group including PG46-34, PG52-34, PG52-28, PG58-28, PG58-22, PG64-28, PG64-22, PG70-22, PG70-28, PG76-22 and any combination thereof so as to provide a composition 100 with the desired properties for the desired application of the composition 100. PG asphalts are produced in accordance with the guidelines established by the American Association of State and Highway Transportation Officials (AASHTO) specification M-312.

Other hydrocarbon materials, media, or components 101 may include petroleum pitch produced under U.S. Pat. No. 4,671,848 (Ashland), U.S. Pat. No. 4,243,513 (Witco) or U.S. Pat. No. 3,140,248 (Mobil). Commercially available pitch products available from Marathon Ashland Petroleum and sold under the designations of A-240, A-225, A-170 or A-40 or from British Petroleum sold under the designation of Trolumen 250. Coal tar and Coal tar pitch may also be utilized with instances of the radioactive shielding composition 100.

Generally, the shielding, binding, and encapsulating instances of the composition 100 may contain from approximately about 0.0 to approximately about 95.0% by weight, with from approximately about 0.0 to approximately about 35% by weight of a hydrocarbon component 101.

The radiation shielding and absorption material 102 may include a variety of materials configured in such a manner that their compositions when combined with the hydrocarbon component 101 (such as an asphalt binder) provide a desired level of shielding and absorption protection for the particular radioactive or radioactive waste material desired to be managed, handled, stored or contained.

In an embodiment, the radiation shielding and absorption material 102 includes virgin and/or recycled glass which contains lead, iron, titanium, or other metals and minerals commonly know to those skilled in the art, naturally occurring or synthesized minerals and their compounds selected from Boron, Aluminum, Coal, Titanium, Sulfur and Sulfates, Iron, or Lithium. Boron compounds may include one or more of the following: Borax, Boron Carbide, Boron Nitride, or any mixtures or combinations thereof. Aluminum chemical and mineralogical compounds may include one or more of the following Bauxite, Cryolite, Boehmite, Gibbsite, Diaspore, Alumina Trihydrates, Aluminum Silicate, or any mixtures or combinations thereof. The Coaliferous compounds may include one or more of bituminous or anthracite coal materials and any mixtures thereof. Titanium compounds include, but are not limited to, one or more of ilmenite, rutile, brookite, anatase, titano-magnetite, or any mixtures thereof. Sulfur compounds include in particular sulfates consisting of one or more selected from gypsum, anhydrite, barite, or any mixtures thereof. Iron chemical and mineralogical compounds include one or more selected from hematite, magnetite, siderite, goethite, limonite, or any mixtures thereof. Lithium compounds may include one or more of the following including lepidolite, spodumene, petalite, amblygonite, or any combination of mixtures thereof. Other elemental additives may include Beryllium, Lead, Cobalt, Nickel, Copper, Zinc, Strontium, Zirconium, Tin, depleted Uranium or any of the alkali or alkaline earth metals, transitional metals or any compounds or mixtures thereof. Other shielding additives may include plastics such as polyethylene, polypropylene, parafinnic and microcrystalline waxes, fischer-tropsch waxes, water, ground concrete, recycled crumb and ground tire rubbers, and hydrated lime.

The radiation shielding and absorbing materials 102 and their compositions, which may be employed, may be selected from virgin and/or recycled materials. In an embodiment, the radiation shielding and absorbing material 102 comprises approximately about 0.5 to approximately about 70% virgin or recycled, non-leachable, leaded glass, which contains from approximately about 0.1 to approximately about 60.0% by weight of lead and which has been processed to a particle size which is suitable for uniform distribution throughout a hydrocarbon binder system. Uniform distribution provides a continuous gamma, neutron, alpha and beta radiation absorbing and shielding composition.

Recycled radiation shielding and absorbing materials 102 may be recovered from waste glass including CRT (Cathode Ray Tube) scrap which has been recovered from computer monitors, television screens and the like. Such recycled material shall be processed so as to remove any leachable materials, which may be present in or on the recycled particles of the material, as described in U.S. Pat. Nos. 6,666,904 and 6,669,757.

In some embodiments, the radioactive shielding composition 100 also includes additional materials or additives 104. Such additives 104 are added in amounts comprising from approximately about 0.1 to approximately about 95% by weight, with approximately about 0.5 to about 75% by weight of the composition 100.

One additive 104 may be surfactants selected from anionic, cationic, or nonionic commercially available products for emulsifying asphalt or other compositions which are widely known to one of ordinary skill in the art. In emulsified forms, surfactants are generally added in amounts comprising from approximately about 0.1 to approximately about 5% by weight, with approximately about 0.2 to approximately about 2.5% by weight of the composition 100.

Another additive 104 may be dispersants added to the composition 100 in order to speed dispersion and to increase the amount of the shielding materials 102 added into instances of the composition 100. Commercially available dispersants from Rohm and Haas under the brand name Tamol, R.T. Vanderbilt under the designation Darvan, as well as many others available from a wide range of vendors are suitable for use with instances of the composition 100. In an embodiment, the composition 100 comprises from approximately about 0.0 to 5% by weight, from approximately about 0.0 to about 2.5% by weight of a dispersant.

Still other materials 104 that may be added to instances of the composition 100 include polymers. Elastomeric or plastomeric polymer modifiers or mixtures thereof may be employed in instances of the composition 100. As used herein, "elastomeric" refers to a composition or compound having "Elastic" or "Rubbery" type memory properties, which remains intact, but gives with stress. That is, it regains its shape once the stress is removed.

Elastomers are commonly a member of the class of polymers known as block copolymers, natural rubber, recycled rubber, ground tire rubber, urethanes, polyurethanes, or polysiloxanes. As used herein, the term "plastomeric" refers to those polymers normally chosen from either polymers or copolymers, which tend to stiffen a mixture but do not offer an elastic or elastomeric benefit.

Polymers are elastomers, selected so as to provide the highly elastomeric and high softening point compositions which remain flexible down to sub zero temperatures while meeting the specific encapsulating and shielding requirements for the particular radioactive material or waste involved with instances of the composition 100. Plastomers may also be used in conjunction with the elastomers for tailoring desired stiffness, and shielding qualities. The amount of each specific type of polymer(s) will vary with the compositional characteristics desired for the intended purpose.

Some of examples of Polymers which may be used as additional material 104 for instances of the composition 100 where the hydrocarbon component 101 is asphalt include Elastomers of Styrene-Butadiene (SB) diblock polymers, Styrene-Butadiene-Styrene (SBS), triblock polymers which may be linear or radial in form, Styrene-Isoprene-Styrene (SIS), diblocked polymers, hydrotreated SBS, Styrene-Ethylene Butadiene-Styrene (SEBS), Styrene-Butadiene Rubber (SBR), Polychloroprene rubber, natural latex rubber, Plastomers employed in the present invention may include polyacrylamide, polyacrylates, methyl methacrylates, Glycidyl-containing ethylene copolymers such as those described in U.S. Pat. No. 5,331,028, polyethylene, oxidized polyethylene, ethylene acrylic acid, ethylene vinyl acetate, ethylene terpolymers and others commonly available under the trade names Elvax, Elvaloy, Polybuilt, Vestoplast, EE-2, etc.

It may be particularly beneficial to add individually or in combination SB, SBS, or SIS copolymers, 2-ethyl-1,3-hexandiol, various glycols including but not limited to polyether and polyester polyols, or hydroxyl terminated polybutadiene polymers (the hydroxyl terminated polybutadiene resins typically have a hydroxyl number of 20-100 and a $M_n$ (molecular weight) of between 1000 and 5000), copolymers thereof with acrylonitrile, castor oil, various vegetable oils, or epoxies and combinations thereof as modifiers to the hydrocarbon component 101 of the composition 100.

In an embodiment, polymers are added in amounts comprising approximately about 0.0. to approximately about 100% by weight, or from approximately about 0.5 to approximately about 75% by weight polymers. The hydroxyl terminated polybutadiene resins typically will have a hydroxyl number of approximately 40-60 and a $M_n$ (molecular weight) of approximately between 1000 and 5000.

The composition 100 also may also include crosslinking or curing agents 103. Curing agents 103 are well know to those of ordinary skill in the art and include, but are not limited to, crosslinkers, accelerators, and catalysts comprising one or more of the following: elemental sulfur, sulfur donors such as various thiurams and dithiocarbamates, zinc 2-mercaptobenzothiasole (ZMBT), Zinc Oxide, Dibutyl Tin Dilaurate, Dioctyltin dilaurate, different tertiary amines, and organometallic compounds of tin, lead, cobalt, and zinc, peroxides, polycarbodiimide-modified diphenylmethane diisocyanates, 2,4 Toluene Diisocyanate, and 2,6-Toluene Diisocyanate, hexamethylene diisocyanates, and isophorone diisocyanates, in one embodiment having a functionality of two or greater. As examples, U.S. Pat. Nos. 5,017,230; 5,756,565; 5,795,929; 6,538,060; and 5,605,946 disclose, and refer to various other patents that disclose various crosslinking and curing agent compositions. For various reasons including costs, environmental impact, and ease of use, elemental sulfur with organic zinc compounds are employed for lower demand systems and compositions.

In special situations, the sulfur can be added with a sulfur donor such as dithiodimorpholine, zinc thiuram disulfide, or any compound with two or more sulfur atoms bonded together. The zinc is added as zinc 2-mercaptobenzothiasole, zinc tetraalkylthiuram disulfide, zinc oxide, zinc dialkyl-2-benzosulfenamide, or other suitable zinc compound or mixtures thereof. In some instances of the compositions 100, where situational conditions demand the highest performance for the widest range of thermal stability and impact resistance, the curing agent 103 is a polycarbodiimide-modified diphenylmethane diisocyanate with or without the addition of a dibutyl-tin dilaurate.

Other materials or additives 104 that may be added to instances or mixtures of the composition 100 include oils or other agents. For example, fluxing or extender oils may be added to mixtures or instances of the composition 100 so as to improve the flow properties of an asphalt component (hydrocarbon component 101) and to provide the finished composition 100 with the degree of flexibility and properties necessary for the particular application of the composition 100.

Fluxing oils may be added to improve the properties of a base asphalt (hydrocarbon component 101) and polymer blend so as to balance the flexibility and softening point of the finished composition 100. Such fluxing components can include parafinnic and/or napthenic, as well as aromatic materials, e.g. gas oils (which can contain both isoparaffins and monoaromatics).

Gas oils include neutral oils, including hydrotreated, hydrocracked, or isodewaxed neutral oils. Suitable parafinnic fluxing components include parafinnic oils having at least 50 wt % parafinnic's content (isoparaffins and normal paraffins)

such as footes oil (which is highly parafinnic and obtained from deoiling slack waxes in refineries) as well as slack wax itself.

Polyalphaolefins (PAO's) are also suited for use as fluxing components. Aromatic oils such as lube plant extracts may also be used, but may not be desired due to their high aromatic content and inherent health hazards. Hydrotreated napthenic and parafinnic oils are desired in some embodiments.

Esters of tallow and vegetable fats and oils are also suitable for extenders and fluxing agents as well as for solvents which may be used in coating applications. The primary constraints on the fluxing components are stability, safety and compatibility. The material should be relatively non-volatile, i.e. have an initial boiling point above 300° F. The oil should be chosen so as to minimize health effects. There is no upper limit, per se, on boiling point and many suitable oils will have distillation end points above 538° C. (1000° F.). The material has a viscosity similar to that of neutral oils or higher. Higher viscosity helps keep the finished compositions 100 of the invention in suitable range so as to not melt and so as to flow under heat yet also so as to be flexible during low temperature exposures. Other suitable extender or flux oils may include FCC Light Cycle Oil, FCC Heavy Naptha, and FCC Slurry Oil or clarified slurry oil, Vegetable oils, esters of fatty acids, Gas Oil, Vacuum Gas Oil, Coker Naptha, Coker Gas Oil, and Aromatic Extracts.

In an embodiment, a hydrotreated napthenic or parafinnic oil is employed in some mixtures of the composition 100 in an amount comprising from approximately about 0.0 to 40% by weight, from approximately about 0.0 to 30% by weight.

A wide variety of chain extending diols can be employed and the choice may affect the cure rate and the physical properties of mixtures of the composition 100. Particularly useful diols are 2-ethyl 1,3 hexanediol, phenyl diisopropanolamine, and bis-hydroxyethyl dimerate. The use of a short chain diol in conjunction with an additional isocyanate increases the urethane concentration in the final composition 100 and this combination leads to increased hydrogen bonding between polymer chains and thus higher strength properties in the final composition. The increased hydrogen bonding further adds to the shielding capabilities for mixtures of the compositions 100.

Still other additional materials or additives that may be included in mixtures of the composition 100 include plasticizers. Plasticisers may be added to mixtures of the composition 100 to impart flexibility, low temperature cracking and impact resistance. They may also include any of the above mentioned extenders or flux oils, Phthalates including but not limited to Dibutylpthalate (DBP) and/or Dioctylpthalate (DOP), various Phosphates, Citrates, polybutadienes, polybutenes, low molecular weight SB, SBS, SEBS, SBR, functional BD Resins, or blends thereof.

In an embodiment, where plasticisers are incorporated into mixtures of the composition 100, they may be included in a range from approximately about 0.0 to about 10.0% by weight, from approximately about 0.0 to approximately about 6.0% by weight.

Still more additional materials or additives 104 that may be added to mixtures of the composition include gellants. Gellants may include chemical gellants such as metallic soaps formed by the neutralization of fatty acids and/or rosin acids; organoclays, e.g. bentonites, hectorites, ball clays, kaolin clays, attapulgus clays, silicas, silicates including but not limited to calcium, magnesium, and/or aluminum, etc.; hydrogenated castor oils, oligomers; siloxanes; or others well known to those of ordinary skill in the art. As used herein "gellants" are typically used in the range from approximately about 0.0 to about 10.0% by weight, from approximately about 0.0 to about 6.0% by weight.

Other additional materials or additives that may be included in mixtures of the composition 100 include antioxidants. Antioxidants are an oxidation inhibiting or stabilizing amount of a composition selected from metal hydrocarbyl dithiophosphates, and mixtures thereof and a composition selected from antioxidant butylated phenols, and mixtures thereof, or others commercially available such as those under the trade names Vanox, Irganox, Cyanox. Antioxidants added into mixtures of the composition are generally added in the range from approximately about 0.0 to about 10.0% by weight or from approximately about 0.0 to about 3.0% by weight.

Miscellaneous additives 104 may also be added to mixtures of the composition 100. The additives 104 may include flame retardants such as Antimony Oxide, calcined aluminum, aluminum trihydrate, chlorinated oils or paraffins, or other flame retardants commonly know to one of ordinary skill in the art. Reinforcement additives such as Kevlar® fiber, cellulose fibers, or polyester fibers may be added to impart mechanical strength to mixtures of the composition 100. Other fillers may include Sepiolite clays, silicas, carbon blacks, or Wollastonite which also add reinforcement and strength to mixtures of the composition 100.

Many other additives 104 known to those or ordinary skill in the art are not listed herein but assumed to be included in the invention as modifiers for use as desired to impart specific desired properties. In an embodiment, additives 104 may be incorporated into the mixtures of the composition 100 in ranges from approximately about 0.0 to 45% by weight or from approximately about 0.0 to about 20% by weight.

In some embodiments, water is also added to mixtures of the composition 100. In an embodiment, deionized or distilled water is used when making emulsions from the hydrocarbon component 101 but standard tap or well (naturally occurring) water may be used. Water with high ionic contents should be avoided so as to produce more stable emulsions for use when spray applying coatings, dust pallatives/binders or membranes of mixtures of the composition 100. In an embodiment, water when used in emulsions for mixtures of the composition 100 may be incorporated in a range from approximately about 0.1 to about 70% by weight or from approximately about 10.0 to approximately about 50.0% by weight.

In an embodiment where the hydrocarbon component 101 is asphalt, then hydrocarbon solvents may be added to mixtures of the composition 100 to reduce the viscosity of the asphalt. This may be useful when the mixtures are being applied as coatings, liners, binders, or dust pallatives. Some hydrocarbon solvents include mineral spirits; napthas; aromatic solvents; kerosenes; compounds of D'Limolene, methyl esters of fatty acids, biodiesel compounds, and fuel oils. In an embodiment, hydrocarbon solvents may be utilized to reduce viscosity for application in the range from approximately about 1.0 to 95% by weight or from approximately about 5.0 to approximately about 50% by weight.

In various embodiments, sufficient or desired heating is applied to or achieved with the mixtures of the composition 100 in order to maintain a fluidity of the mixture for mixing, pumping, application and/or flow of the composition. In a like manner, pressure is an optional control parameter when constructing mixtures of the composition 100, and thus, in one embodiment, the pressure during initial formation of the composition 100 is normal atmospheric pressure. Furthermore, in one embodiment, mixtures of the composition 100 are formed as a batch process. In another embodiment, the mixtures of the composition are formed with continuous processing with continuous mixing of the ingredients as they are pumped or fed into casks, containers, reservoirs, piping, vessels, or as coatings, binders, pallatives, lines, or the like.

Mixtures of the composition 100 provide for novel impact and temperature resistant radioactive shielding and absorptive modified compositions containing a radiation shielding and absorptive improvement additive or material 102 of (a) a composition selected from virgin or recycled radiation shielding and/or absorption additives, optionally (b) an Elastomeric or polymeric polymer modifier 104 composition and combinations thereof, (c) a hydrocarbon component 101, and (d) a crosslinking and/or curing agent 103. Ingredients (a), (b), (c) and (d) may all be present in mixtures of the composition 100 or may be present in part.

Generally, the modified radioactive shielding and absorption materials 102 of the invention comprise, (a) from approximately about 0.1 to approximately about 85 wt. % of a virgin or recycled radioactive shielding and/or absorption additive(s) and mixtures thereof, and (b) from approximately about 0.0 to about 95 wt. % of a composition selected from Elastomeric and/or plastomeric polymer modifiers 104 and combinations thereof, (c) from about 0.0 to approximately about 95 wt. % a hydrocarbon component 101 selected from naturally occurring or refinery produced asphalt, petroleum pitch, SDA or ROSE bottoms, vacuum tower bottoms, coal tar or coal tar pitch, and (d) from approximately about 0.0 to about 50 wt. % of a crosslinking and/or curing agent 103 or mixtures thereof.

Unless indicated otherwise, all compositions percentages given herein are by weight, based upon the total weight of the composition. The virgin or recycled radiation shielding and absorbing additive 102 may be present in an amount from approximately about 10 to 85 wt. %. The Elastomeric and/or plastomeric polymer modifiers 104 and combinations thereof may be present in an amount from approximately about 0.0 to approximately about 85 wt. %. The hydrocarbon component 101 of the invention may be present in an amount from approximately about 0.0 to 80 wt. %. The crosslinking and/or curing agents 104 and combinations thereof may be present in an amount from approximately about 0.0 to about 40.0 wt. %. In some embodiments, other additives 104 such as extender oils, extender diols, fillers, antioxidants, and fire retardants may be added so as to tailor the composition 100 to meet specific application requirements for the radioactive shielding composition 100. All percents are by weight of the total composition and are provided for purposes of illustration only.

Figure 2:
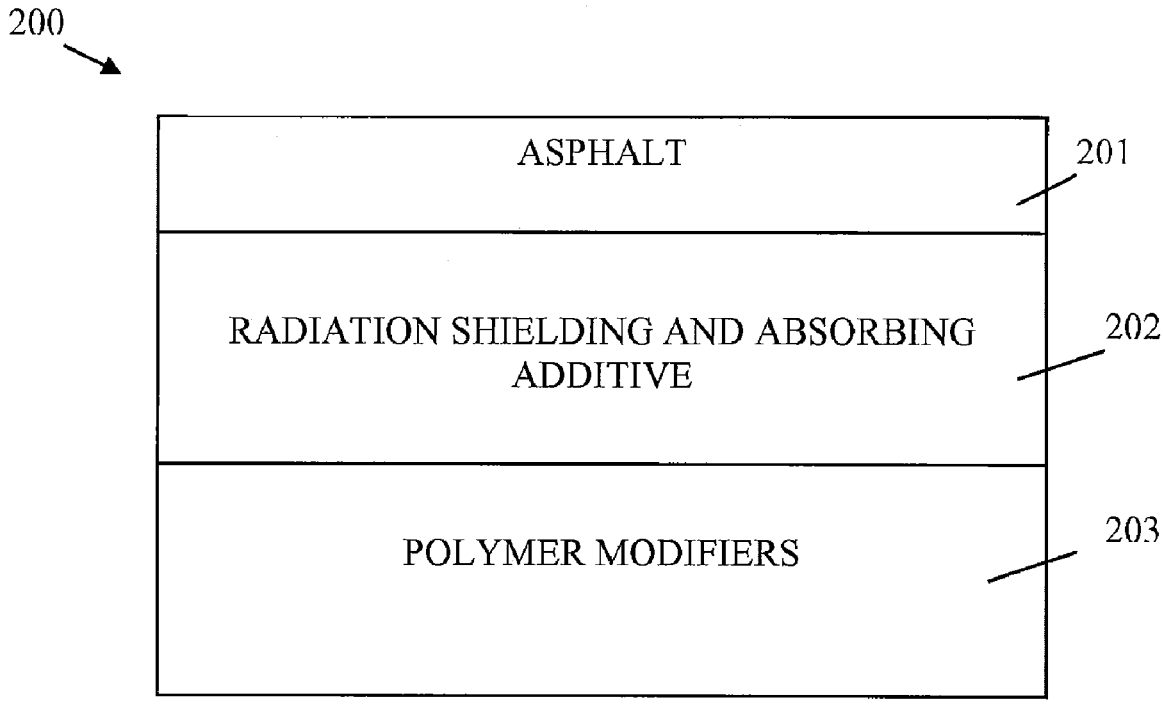
FIG. 2 is a block diagram of another radioactive shielding composition, according to an example embodiment of the invention.

FIG. 2 illustrates a block diagram of another radioactive shielding composition 200, according to an example embodiment of the invention. The radioactive shielding composition 200 includes asphalt 201 and a radiation shielding and absorbing additive 202. In one embodiment, the radioactive shielding composition 200 also includes polymer modifiers 203.

In an embodiment, the composition 200 includes a radiation shielding and absorbing additive 202 that is leaded glass particles. The leaded glass particles may be derived from recycled glass waste or virgin glass.

In an embodiment, the glass particles are manufactured or supplied to the composition with diameter sizes of 2 millimeters or less. In this manner, the lead and other heavy metals are not practically capable of leaching from the glass particles. Moreover, the remaining non-leachable lead and other heavy metals act as a good radiation shielding and absorbing additive 202 for the composition 200.

Furthermore, the asphalt 201 may be custom blended from naturally occurring bitumen or as bitumen derived from petroleum processing. Moreover, a desired viscosity for the asphalt 201 may be achieved with other additives or other materials mixed within the custom blended asphalt 201.

In an embodiment, the composition 200 also includes an elastomeric or plastomeric polymer modifier 203. Other mixtures of the composition 200 may include crosslinking or curing agents.

Mixtures of the composition 200 may be manufactured in various forms such as liquids, aerosols, solids, and incorporated as coatings on radioactive waste or as coatings on substrates that interface with radioactive waste. Additionally, the composition 200 may be integrated into raw materials associated with products that interface with radioactive waste, such as containers, etc.

Figure 3:
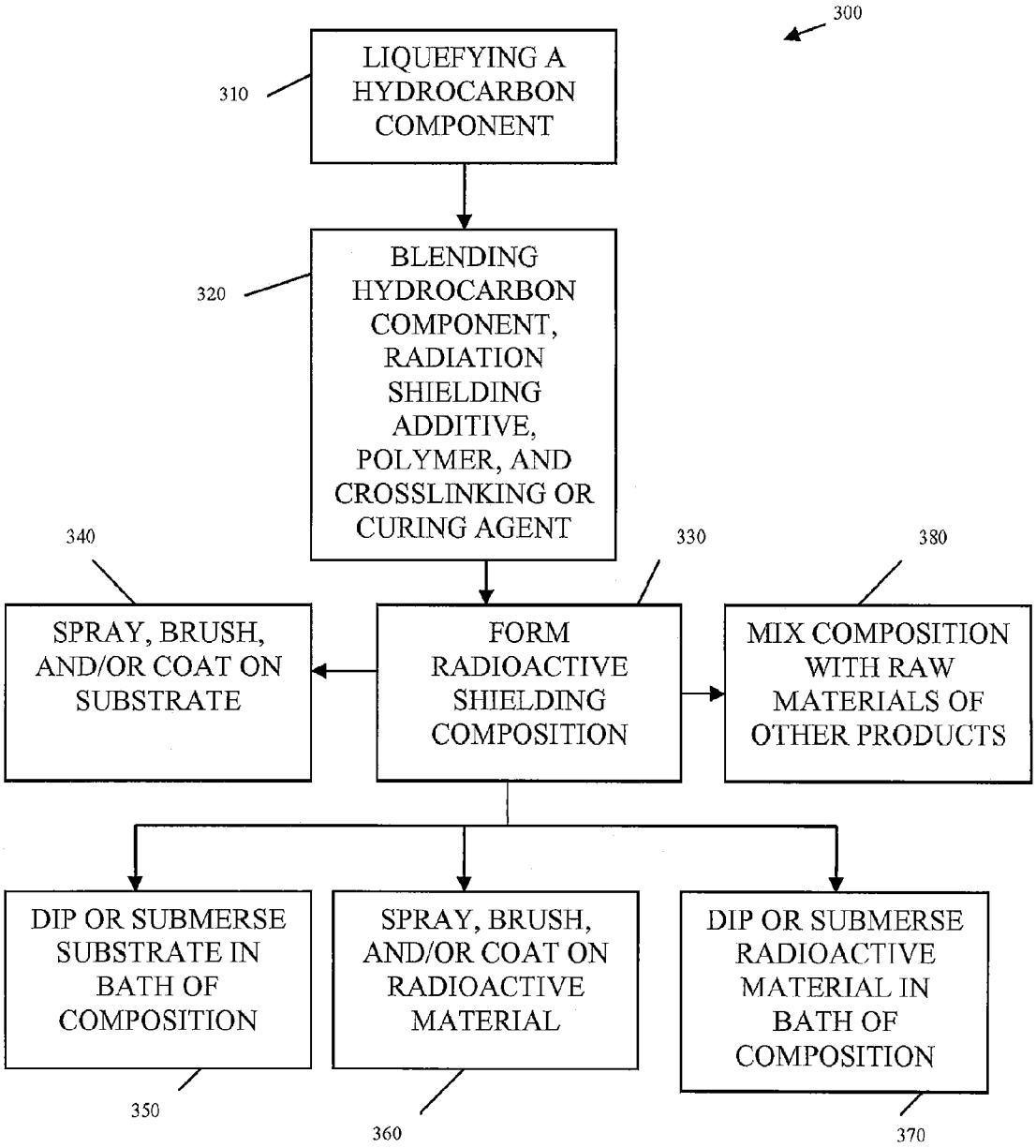
FIG. 3 is a diagram of a method for forming and applying a radioactive shielding composition, according to an example embodiment of the invention.

FIG. 3 is a diagram of a method 300 for forming a radioactive shielding composition and applying or integrating the composition, according to an example embodiment of the invention. In an embodiment, the method 300 is adapted to produce mixtures or instances of the compositions 100 and 200 of FIGS. 1 and 2.

Initially, at 310, a hydrocarbon component is liquefied. That is, a hydrocarbon component, such as asphalt, is heated or otherwise acquired in a form that is fluid or liquid. Next, at 320, the hydrocarbon component is blending or mixed with a radiation shielding additive, a polymer, and a crosslinking or curing agent. At 330, a radioactive shielding composition is formed from at the conclusion of the blending.

In an embodiment, at 340, the formed radioactive shielding composition is sprayed, rolled, brushed, and/or coated onto a substrate. In some embodiments, the substrate is a container made of plastic, metal, cement, rubber, and the like. In other embodiments, the substrate is rock, cement, sand, gravel, dirt, and the like. The coating of the radioactive shielding composition on the substrate forms a durable, weather-resistant radiation absorber and shield.

In another embodiment, at 350, a substrate is dipped or submersed into a bath of the formed radioactive shielding composition, such that all sides and surfaces of the substrate are coated with the composition.

In yet other embodiments, at 360, the formed radioactive shielding composition is sprayed, rolled, brushed, and/or coated onto one or more surfaces of radioactive waste material. In other cases, at 370, the radioactive waste material is dipped or submersed into a bath of the composition.

In still more embodiments, at 380, the radioactive shielding composition is mixed with raw materials of manufactured products, such that the manufactured products exhibit radiation shielding and absorbing properties and characteristics associated with the composition. In this manner, containers and other products may be manufactured with a portion of their composition including the radioactive shielding composition.

The method 300 improves the radioactive emission shielding performance, radioactive emission absorbing performance, impact resistance, and temperature susceptibility of radioactive emission shielding and absorbing compositions produced by blending the ingredients at a temperature sufficient to liquefy the hydrocarbon component, a virgin or recycled radiation shielding and absorbing additive or mixtures thereof, an elastomeric and/or plastomeric polymer modifier and/or combinations thereof, a naturally occurring or refined hydrocarbon component and/or mixtures thereof, a crosslinking and/or curing agent in a configurable ratio to the elastomeric or plastomeric additives, as described more fully hereinafter.

In an embodiment, the components or ingredients are added so that the radiation shielding composition comprises from approximately about 0.1 to 85.0 wt. % of a composition selected from virgin and/or recycled radiation absorbing and shielding additives and/or mixtures thereof, from approximately about 0.0 to 95.0 wt. % of an elastomeric and/or plastomeric polymer modifier and/or combinations thereof, from approximately about 0.0 to 95.0 wt. % of a naturally occurring or refined hydrocarbon component and/or mixtures thereof, and from approximately about 0.0 to 5.0 wt. % of a crosslinking and/or curing agent or mixtures thereof in a specified ratio to the elastomeric or plastomeric polymer modifiers as described more fully hereinafter.

In another embodiment, the virgin or recycled radioactive shielding and/or absorbing additives or mixtures thereof is supplied in an amount from approximately about 10.0 to 85 wt. %, the elastomeric and/or plastomeric polymer modifier or mixtures thereof supplied in an amount from approximately about 0.0 to 85.0 wt. %, the naturally occurring or refined hydrocarbon components and/or mixtures thereof is supplied in an amount from approximately about 0.0 to 80.0 wt. %, and the crosslinking and/or curing agents, or mixtures thereof are supplied in an amount from approximately about 0.0 to 40.0 wt. %. All percentages are percent by weight of the total composition.

In yet another embodiment, the method 300 relates to a novel impact and temperature resistant radiation shielding and absorbing compositions which may be spray, brushed, or flow applied to various substrates and radioactive emitting sources comprising a virgin or recycled radiation shielding and absorbing additive or mixtures thereof, an elastomeric and/or plastomeric polymer modifier and/or combinations thereof, a naturally occurring or refined hydrocarbon component and/or mixtures thereof, a crosslinking and/or curing agent in a specified ratio to the elastomeric or plastomeric additives, and a dilution solvent suitable for reducing viscosity of the composition so as to render it easily sprayable, brushable, or flowable onto the desired substrate to be protected or into a containment vessel or shielding vessel as described more fully hereinafter. For example, the components are added so that the radiation shielding composition comprises from approximately about 0.1 to 85 wt. % of a composition selected from virgin and/or recycled radiation absorbing and shielding additives and/or mixtures thereof, from approximately about 0.0 to 95.0 wt. % of an elastomeric and/or plastomeric polymer modifier and/or combinations thereof, from approximately about 0.0 to 95.0 wt. % of a naturally occurring or refined hydrocarbon component and/or mixtures thereof, and from approximately about 0.0 to 50.0 wt. % of a crosslinking and/or curing agent or mixtures thereof in a specified ratio to the elastomeric or plastomeric polymer modifiers as described more fully hereinafter.

In another example, the virgin or recycled radioactive shielding and/or absorbing additives or mixtures thereof is supplied in an amount from approximately about 10.0 to 85 wt. %, the elastomeric and/or plastomeric polymer modifier or mixtures thereof supplied in an amount from approximately about 0.0 to 85.0 wt. %, the naturally occurring or refined hydrocarbon components and/or mixtures thereof is supplied in an amount from approximately about 0.0 to 80.0 wt. %, the crosslinking and/or curing agents or mixtures thereof are supplied in an amount from approximately about 0.0 to 40.0 wt. %, and the hydrocarbon solvents and/or mixtures thereof are supplied in an amount from approximately about 0.5 to about 95.0 wt. %. The percentages are percentages by weight for the total composition produced by the method 300.

In still other embodiments, the method 300 relates to a novel, impact and temperature resistant radiation shielding and absorbing emulsified compositions which may be spray, brushed, or flow applied to various substrates and radioactive emitting sources comprising a virgin or recycled radiation shielding and absorbing additive or mixtures thereof, an elastomeric and/or plastomeric polymer modifier and/or combinations thereof, a naturally occurring or refined hydrocarbon component and/or mixtures thereof, a crosslinking and/or curing agent in a configurable ratio to the elastomeric or plastomeric additives, an anionic, cationic, or nonionic emulsifier composition and/or mixtures thereof, and an amount of water suitable for reducing viscosity of the composition so as to render it easily sprayable, brushable, or flowable onto the desired substrate to be protected or into a containment vessel or shielding vessel as described more fully hereinafter. For example, the components may be added so that the radiation shielding composition comprises from approximately about 0.1 to 85.0 wt. % of a composition selected from virgin and/or recycled radiation absorbing and shielding additives and/or mixtures thereof, from approximately about 0.0 to 95.0 wt. % of an elastomeric and/or plastomeric polymer modifier and/or combinations thereof, from approximately about 0.0 to 95.0 wt. % of a naturally occurring or refined hydrocarbon component and/or mixtures thereof, and from approximately about 0.0 to 40.0 wt. % of a crosslinking and/or curing agent or mixtures thereof in a specified ratio to the elastomeric or plastomeric polymer modifiers as described more fully hereinafter. In another example, the virgin or recycled radioactive shielding and/or absorbing additives or mixtures thereof is supplied in an amount from approximately about 1.0 to 85 wt. %, the elastomeric and/or plastomeric polymer modifier or mixtures thereof supplied in an amount from approximately about 0.0 to 85.0 wt. %, the naturally occurring or refined hydrocarbon components and/or mixtures thereof is supplied in an amount from approximately about 0.0 to 80.0 wt. %, the crosslinking and/or curing agents or mixtures thereof are supplied in an amount from approximately about 0.0 to 40.0 wt. %, the anionic, cationic, and/or nonionic emulsifiers and/or mixtures thereof are supplied in an amount from approximately about 0.1 to approximately about 10.0 wt. %, and water in an amount from approximately about 0.5 to 80.0 wt. %. The percentages are percentages by weight of the total composition.

In an embodiment, the method 300 relates to novel, impact and temperature resistant, radiation shielding and absorbing encapsulant and filler compositions, comprising an nuclear radiation emitting source and from about 10.0 to 99% of the novel modified radiation shielding and absorbing compositions described herein.

In more particular embodiments, the method 300 is directed to specific methods of applications and compositions thereof, such as novel shielding/absorbing fillers for cask type multi-wall shipping containers, protective barrier sheets, shielding and absorbing coatings, and binders for radioactive materials and wastes thereof. Compositions produced from the method 300 may be incorporated into radioactive shielding/absorption applications or in the radioactive waste handling and storage applications by hot melt application, use as solvent cutbacks, or as emulsions for a variety of applications for protecting workers and the environment when handling and disposing of nuclear waste and radioactive materials.

The compositions of the method 300 further provide for a material which can be used to line and waterproof nuclear waste storage sites or facilities using nuclear materials, used to fill cracks in the structures thereof, incorporated into the radioactive material storage containers themselves, line drainage ditches and troughs to provide a barrier from the soil underneath so as to prevent further contamination from leaching and runoff, be applied to underlying soils prior to pouring concrete slabs to prevent the migration of Radon gas into basements or living areas, or pumped through contaminated piping so as to bind and contain any loose particles or dust into a solid mass for collection and disposal. The method 300 also provides for a process whereby the compositions of the method 300 may be used to bind and solidify contaminated waste materials to be extruded into containers for disposal.

Accordingly, embodiments of the present invention provide novel compositions comprising the use of at least approximately about 5.0 to 95.0% of a hydrocarbon medium or component, wherein an example hydrocarbon medium is petroleum asphalt, into which has been incorporated a stabilizing amount of polymer(s), a reactive amount of curing agents, crosslinkers, or reactants so as to stabilize the polymer and incorporate it intimately with the asphalt, fillers or extenders to provide body and additional shielding or absorption, a stabilizing amount of antioxidants or stabilizers, and an amount of virgin or recycled radioactive shielding or absorptive additives suitable to provide the degree of shielding and absorption so desired for the application, including but not limited to alpha, beta, gamma and neutron shielding mediums. The novel compositions of the present invention may be used in a wide variety of applications for containing, managing, handling, storage and disposal of nuclear wastes. They are particularly unique in that they remain functional over a wide range of temperatures, provide Alpha, Beta, Gamma and Neutron shielding capabilities as well as function as a barrier and shielding material for many other types of radiation including but not limited to X-rays, Radon, and other types commonly known to those of ordinary skill in the art.

The use of the hydrocarbon medium with the radioactive shielding and absorptive mediums provides for a synergistic effect due to the presence of polar constituents and the presence of a significant number of hydrogen molecules present in the hydrocarbon medium. As natural occurring elements within the asphalt component, they help to both shield and absorb various types of radiation emissions. Further, the addition of additional metals, their alloys, additives and minerals, both synthesized and naturally occurring can provide additional levels of shielding and absorption. The invention further provides for method(s) 300 whereby the compositions of the invention may be incorporated in or used as encapsulants, stabilizing, shielding, and preventing any leaching of the radioactive materials from the containment system, shielding fillers for cask type multi-wall shipping containers, protective barrier sheets, coatings, and binders thereof. They may be applied or incorporated into radioactive shielding applications or into the radioactive waste handling and storage applications by hot melt application, reactive one and two component systems, use as solvent cutbacks, or as emulsions which solidify upon application to satisfy a variety of needs for protecting workers and the environment when handling and disposing of nuclear waste and/or radioactive materials. They further provide for a material which can be used to waterproof the nuclear waste storage sites, incorporated into the storage containers themselves, line drainage ditches and troughs to provide a barrier to the soil underneath so as to prevent further contamination, or be applied to underlying soils prior to pouring concrete flooring slabs to prevent the migration of Radon gas into basements or living areas.

Any suitable hydrocarbon component or asphalt cement may be employed for producing mixtures of the radiation shielding and absorbing compositions of the invention. For example, industrial asphalts used for coatings, sealants, roofing materials, adhesives, and other applications may be used. Paving grade asphalt compositions are employed in some embodiments. Asphalt compositions may be derived, as previously indicated, from any well known bituminous or asphaltic substance obtained from natural sources or derived from a number of sources such as petroleum, shale oil, coal tar, tar sands, and the like, as well as mixtures of two or more of such materials. Typical of such asphalts are the straight run asphalts derived from atmospheric, steam and/or vacuum distillation of crude oils, or those asphalts derived from solvent precipitation treatments of raw lubricating oils and their fractions. Also included are the thermal or "Cracked" asphalts which are separated as cracker bottom residues from refinery cracking operations and the asphalts produced as byproducts in hydro refining operations. Example asphalt is the vacuum tower bottoms that is produced during the refining of synthetic or petroleum oils. The asphalt may be treated or modified before use in the invention; so called "Blown" or "Oxidized" asphalts are used in roofing shielding compositions but may be also employed for encapsulant and filler applications when modified according to the invention. As indicated, for encapsulating and filler as well as coating compositions, any suitable paving grade asphalt may be employed as the hydrocarbon component for the compositions of the invention. Such paving grade asphalt compositions are often referred to as viscosity, penetration graded or performance graded (PG) asphalts having penetrations up to 500 as measured by ASTM method D5. Some example asphalts include the performance-graded asphalts such as PG46-40, PG46-34, PG46-28, PG52-40, PG52-34, PG52-28, PG52-22, PG58-40, PG58-34, PG58-28, PG58-22, PG64-40, PG64-34, PG64-28, PG64-22, PG64-16, PG70-34, PG70-28, PG70-22, PG70-16, PG70-10, PG76-34, PG76-28, PG76-22, PG76-16, PG76-10, PG82-34, PG82-28, PG82-22, PG82-16, or PG82-10. The PG in the title referring to Performance Grade, the first numeric designation referring to the binder's high temperature resistance range, and the last numeric designation referring to the binder's low temperature thermal cracking resistance range. Complete specification requirements are outlined under AASHTO Performance Graded Asphalt Binder Specifications. AASHTO is the designation for the American Association of State and Highway Transportation Officials.

In an example manufacturing environment, the method 300 may be performed as follows. A mixing vessel equipped with air and nitrogen purging, agitation, and circulation are added in order 23.31 parts by weight of molten PG64-22 asphalt cement at a temperature sufficient to maintain pumpability and adequate mixing capability, 23.31 parts by weight of a Hydroxyl Terminated Polybutadiene polymer manufactured by Sartomer Corporation and marketed under the trade name R45HTLO. The polybutadiene polymer is allowed to pre-wet into the asphalt cement under agitation and mixing at temperatures between 180 and 280° F. Once the polymer is pre-wet and mixture is smooth and homogeneous, 2.33 parts by weight of napthenic extender oil is added, and the mixture continues to mix until homogeneous. The mixture is then stored at 200-250° F. with or without nitrogen purging as desired to minimize any moisture in the mixing vessel until it is pumped to an external mixing vessel where 46.62 parts of the radiation shielding and absorption additive is added under mixing and allowed to completely wet into the asphalt and polymer composition. Once mixed and homogeneous, the material is pumped through an inline mixing apparatus where it is mixed till homogeneous with 4.43 parts of a polycarbodiimide-modified diphenylmethane diisocyanate as the material is applied as a liner/filler material to radiation shielding storage casks for handling radiation emitting materials and wastes. Compositions produced according to the example will provide flexible, impact absorbing, temperature resistant, radioactive emission shielding and absorbing fillers and encapsulants for radioactive storage containers.

Various other equipment and techniques and portions of the ingredients may be deployed to practice the method 300 and to produce the compositions 100 and 200. As more examples, compositions may be produced with ratios and/or ingredient combinations as follows: 4 parts asphalt to 1 part polymer; asphalt and radiation shielding and absorbing material without polymers; 1 part PG58-28 Base Asphalt to 1 part Polymer; PG64-22 asphalt and coarse sieve size radiation shielding and absorbing material; PG64-22 and an Extender Polyol; SBS and asphalt and radiation shielding and absorbing material; SBS, Sulfur Crosslinker, and asphalt and radiation shielding and absorbing material; SBS Peroxide Crosslinker and asphalt and radiation shielding and absorbing material; composition with Kevlar Fibers; composition with Fire Retardants (aluminum trihydrates); and Comparative Asphalt without Polymer and asphalt and radiation shielding and absorbing material.

Although specific embodiments have been illustrated and described herein, those of ordinary skill in the art will appreciate that any arrangement calculated to achieve the same purpose can be substituted for the specific embodiments shown. This disclosure is intended to cover any and all adaptations or variations of various embodiments of the invention. It is to be understood that the above description has been made in an illustrative fashion, and not a restrictive one. Combinations of the above embodiments, and other embodiments not specifically described herein will be apparent to one of ordinary skill in the art upon reviewing the above description. The scope of various embodiments of the invention includes any other applications in which the above structures and methods are used. Therefore, the scope of various embodiments of the invention should be determined with reference to the appended claims, along with the fall range of equivalents to which such claims are entitled.

It is emphasized, that the Abstract is provided in order to comply with 37 C.F.R. §1.72(b). This requires that the Abstract allow a reader to quickly ascertain the nature and gist of the technical disclosure. It is submitted with the understanding that it will not be used to interpret or limit the scope or meaning of the claims.

In the foregoing Detailed Description, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate independent embodiment.

The invention claimed is:

1. A method, comprising:

liquefying an asphalt hydrocarbon component, wherein the asphalt hydrocarbon component is blended with Solvent De-asphalted Pitch (SDA) bottoms to produce asphalt having a viscosity of 500 to 2000 poise at 60.degree. C. (140.degree. F.);

blending the liquefied asphalt hydrocarbon component with a radiation shielding and absorbing material that includes leaded glass particles derived from recycled glass waste or virgin glass, and wherein the leaded glass particles are supplied to the composition with diameter sizes of 2 millimeters or less; a polymer which is other than said asphalt hydrocarbon component; and a crosslinking or curing agent; and forming a radioactive shielding composition from the blended liquefied asphalt hydrocarbon component, the radiation shielding additive, the polymer, and the cross linking or curing agent.

2. The method of claim 1, further comprising at least one of: spraying, brushing, or coating a substrate with the radioactive shielding composition.

3. The method of claim 1, further comprising dipping or submersing a substrate in a bath of the radioactive shielding composition.

4. The method of claim 1, further comprising at least one of spraying, brushing or coating the radioactive shielding composition on radioactive material.

5. The method of claim 1, further comprising dipping or submersing radioactive material in a bath of the radioactive shielding composition.

6. The method of claim 1, further comprising mixing the radioactive shielding composition with raw materials associated with at least one of sealants, paints, glues, plastics, metals, foams, cements, and rubbers.

* * * * *

UNITED STATES PATENT AND TRADEMARK OFFICE

CERTIFICATE OF CORRECTION

PATENT NO. : 7,553,431 B2
APPLICATION NO. : 12/245228
DATED : June 30, 2009
INVENTOR(S) : Roger E. Hayner et al.

It is certified that error appears in the above-identified patent and that said Letters Patent is hereby corrected as shown below:

In column 1, line 7, delete "Continuation" and insert -- divisional --, therefor.

Signed and Sealed this

Sixth Day of October, 2009

David J. Kappos

David J. Kappos
*Director of the United States Patent and Trademark Office*